US007998314B2

(12) United States Patent
Koch et al.

(10) Patent No.: US 7,998,314 B2
(45) Date of Patent: Aug. 16, 2011

(54) METHOD FOR THE PRODUCTION OF PAPER, CARDBOARD AND CARD

(75) Inventors: Oliver Koch, Eppelheim (DE); Frank Prechtl, Frankfurt (DE); Rainer Blum, Mannheim (DE); Detlef Kannengiesser, Zwingenberg (DE)

(73) Assignee: BASF Aktiengesellschaft, Ludwigshafen (DE)

( * ) Notice: Subject to any disclaimer, the term of this patent is extended or adjusted under 35 U.S.C. 154(b) by 1090 days.

(21) Appl. No.: 11/722,468

(22) PCT Filed: Dec. 17, 2005

(86) PCT No.: PCT/EP2005/013631

§ 371 (c)(1),
(2), (4) Date: Jun. 21, 2007

(87) PCT Pub. No.: WO2006/069660

PCT Pub. Date: Jul. 6, 2006

(65) Prior Publication Data

US 2010/0282424 A1 Nov. 11, 2010

(30) Foreign Application Priority Data

Dec. 22, 2004 (DE) ..... 10 2004 063 005

(51) Int. Cl.
*D21F 11/00* (2006.01)

(52) U.S. Cl. ..... 162/158

(58) Field of Classification Search ..... 162/158, 162/164.4, 164.1

See application file for complete search history.

(56) References Cited

U.S. PATENT DOCUMENTS

| | | | |
|---|---|---|---|
| 3,052,595 | A | 9/1962 | Pye |
| 4,753,710 | A | 6/1988 | Langley et al. |
| 4,798,653 | A | 1/1989 | Rushmere |
| 5,126,014 | A | 6/1992 | Chung |
| 5,393,381 | A | 2/1995 | Hund et al. |
| 6,103,065 | A | 8/2000 | Humphreys et al. |
| 6,719,881 | B1 | 4/2004 | Hunter et al. |
| 2002/0166648 | A1 | 11/2002 | Frolich et al. |
| 2003/0150575 | A1 | 8/2003 | Hund et al. |

FOREIGN PATENT DOCUMENTS

| | | |
|---|---|---|
| DE | 102 36 252 | 5/2003 |
| EP | 0 017 353 | 10/1980 |
| EP | 0 223 223 | 5/1987 |
| EP | 0 235 893 | 9/1987 |
| EP | 0 335 575 | 10/1989 |
| EP | 0 608 986 | 8/1994 |
| EP | 0 711 371 | 5/1996 |
| EP | 0 885 328 | 12/1998 |
| EP | 0 910 701 | 4/1999 |
| EP | 1 039 026 | 9/2000 |
| EP | 1 475 476 | 11/2004 |
| WO | 92 20862 | 11/1992 |
| WO | 93 14263 | 7/1993 |
| WO | 99 63159 | 12/1999 |
| WO | 99 66130 | 12/1999 |
| WO | 01 34910 | 5/2001 |

*Primary Examiner* — Mark Halpern

(74) *Attorney, Agent, or Firm* — Oblon, Spivak, McClelland, Maier & Neustadt, L.L.P.

(57) ABSTRACT

A method for the production of paper, cardboard and card by adding a microparticle system consisting of a polymer retention agent having a molar mass $M_w$ of at least 2 million and a fine-part inorganic component in order to form a paper material having a material density of a 20 g/l maximum and by dewatering the paper material, wherein the paper material undergoes at least one shearing step prior to or after addition of the retention agent and wherein the retention agent is introduced in a dosed manner into the paper material in at least two places and the fine inorganic component is dosed prior to or after addition of the retention agent or between two dosing points for the retention agent.

20 Claims, No Drawings

METHOD FOR THE PRODUCTION OF PAPER, CARDBOARD AND CARD

This application is a 371 of PCT/EP05/13631 filed on 17 Dec. 2005

The invention relates to a process for producing paper, board and cardboard by adding a microparticle system comprising a polymeric retention aid having a molar mass $M_w$ of at least 2 million and a finely divided inorganic component to a paper stock having a density of not more than 20 g/l and draining the pulp, the paper stock being subjected, before or after the addition of the cationic retention aid, to at least one shear stage.

The use of combinations of nonionic or anionic polymers and bentonite as retention aids in papermaking is known for example from U.S. Pat. No. 3,052,595 and EP-A-0 017 353.

EP-A-0 223 223 discloses a process for producing paper and cardboard by draining a paper stock, a paper stock having a concentration of 2.5% to 5% by weight being first admixed with bentonite and then diluted, admixed with a highly cationic polymer having a charge density of at least 4 meq/g and finally with a high molecular mass polymer based on acrylamide, and then mixed thoroughly and drained.

According to the papermaking process known from EP-A-0 235 893 a substantially linear synthetic cationic polymer having a molar mass of more than 500 000 is metered in an amount of more than 0.03% by weight, based on dry paper stock, into an aqueous fiber suspension, the mixture is then subjected to the action of a shear field, in the course of which the flocs formed initially are broken down into microflocs which carry a cationic charge, bentonite is then metered in, and the resulting pulp is drained without further exposure to shear forces.

EP-A-0 335 575 describes a papermaking process in which first a polymeric cationic fixing agent and subsequently a water-soluble cationic polymer are metered into a pulp and the resulting pulp is then subjected to at least one shear stage and subsequently flocculated by addition of bentonite.

In EP-A-0 885 328 a process for producing paper is described in which first a cationic polymer is metered into an aqueous fiber suspension, the mixture is then subjected to the action of a shear field, subsequently an activated bentonite dispersion is added, and the resulting pulp is drained.

EP-A 0 711 371 discloses a further process for producing paper. In this process a synthetic, cationic polymer of high molecular mass is added to a high-consistency cellulose pulp suspension. After the flocculated high-consistency pulp had been diluted, and before it is drained, a coagulation aid consisting in an inorganic coagulant and/or a second polymer, which is of low molecular mass, is highly cationic and is soluble in water, is added.

EP-A-0 910 701 describes a process for producing paper and cardboard in which a cationic polymer of low or average molecular mass, based on polyethyleneimine or polyvinylamine, and subsequently a cationic polymer of high molecular mass, such as polyacrylamide, polyvinylamine or cationic starch, are added in succession to the paper stock. When this pulp has been subjected to at least one shear stage it is flocculated by addition of bentonite and the paper stock is drained.

From EP-A-0 608 986 it is known to meter a cationic retention aid into the high-consistency pulp during papermaking. A further process for producing paper and cardboard is known from U.S. Pat. No. 5,393,381, WO-A-99/66130 and WO-A-99/63159, again using a microparticle system comprising a cationic polymer and bentonite. The cationic polymer used is a water-soluble, branched polyacrylamide.

WO-A-01/34910 describes a process for producing paper in which a polysaccharide or a synthetic polymer of high molecular mass is metered into the paper stock suspension. The paper stock must undergo subsequent mechanical shearing. Reflocculation is accomplished by adding an inorganic component such as silica, bentonite or clay and a water-soluble polymer.

Known from U.S. Pat. No. 6,103,065 is a process for improving the retention and drainage of paper stocks, in which a cationic polymer having a molar mass of from 100 000 to 2 million and a charge density of more than 4.0 meq./g is added to a paper stock after the last shear, at the same time or subsequently a polymer having a molar mass of at least 2 million and a charge density of less than 4.0 meq./g is added, and subsequently bentonite is metered in. With this process there is no need to subject the paper stock to shearing after the polymers have been added. Following addition of the polymers and the bentonite, the pulp can be drained without further exposure to shear forces, with sheets being formed.

DE-A-102 36 252 discloses a process for producing paper, board and cardboard by shearing a paper stock, adding a microparticle system comprising a cationic polymer and a finely divided inorganic component to the pulp after the last shear stage upstream of the headbox, dewatering the paper stock, with formation of sheets, and drying the sheets, the cationic polymer used in the microparticle system comprising cationic polyacrylamides, polymers comprising vinylamine units and/or polydiallyldimethylammonium chloride having an average molar mass $M_w$ of in each case at least 500 000 daltons and a charge density of in each case not more than 4.0 meq./g.

The known papermaking processes which involve using a microparticle retention aid system necessitate relatively large amounts of polymer and bentonite. Those processes which necessarily require the accompanying use of cationic polymers with a charge density of more than 4.0 produce papers which tend toward yellowing. The microparticle processes known to date for papermaking, moreover, have the drawback that they are out of step with the present requirements in terms of formation and retention of filler and of fines.

The object on which the present invention is based is to provide a further process for producing paper, board and cardboard using a microparticle system, obtaining better retention and better papers, with improved formation, in comparison to the known processes.

This object is achieved in accordance with the invention by means of a process for producing paper, board and cardboard by adding a microparticle system comprising at least one polymeric retention aid having a molar mass $M_w$ of at least 2 million and a finely divided inorganic component to a paper stock having a density of not more than 20 g/l and draining the paper stock, the paper stock being subjected, before or after the addition of the retention aid, to at least one shear stage, if the retention aid is metered into the paper stock at least two places and the finely divided inorganic component is metered before or after the addition of the retention aids or between two metering places for retention aid.

The process of the invention can be used to produce all grades of paper, e.g., cardboard, single-ply or multi-ply folding boxboard, single-ply or multi-ply liners, fluted medium, newsprint, medium writing and printing papers, natural gravure papers and lightweight coating papers. The starting material for producing such papers may be, for example, groundwood, thermomechanical pulp (TMP), chemothermomechanical pulp (CTMP), pressure groundwood (PGW), mechanical pulp, and sulfite and sulfate pulp. The pulps may be both short-fiber and long-fiber pulps. It is, however, also possible to use fibers recovered from wastepaper, alone or in a mixture with other fibers, for producing paper, board and cardboard. The process of the invention is used preferably to produce wood-free grades which give very white paper products.

The papers can if appropriate comprise up to 40%, usually 5% to 35%, by weight of fillers. Examples of suitable fillers include titanium dioxide, natural and precipitated chalk, talc, kaolin, satin white, calcium sulfate, barium sulfate, clay or alumina.

The paper products are produced continuously. Normally the starting point is a high-consistency pulp with a density, for example, in the range from 3% to 6% by weight. The high-consistency pulp is diluted to a density of not more than 20 g/l and is processed in accordance with the invention to the particular paper product desired. The pulp density is for example 3 to 15 g/l, preferably 5 to 12 g/l, and in the majority of cases is situated in the range from 6 to 10 g/l.

The microparticle system is composed, in accordance with the invention, of at least one polymeric retention aid having a molar mass $M_w$ of at least 2 million and of a finely divided inorganic component. The retention aid may carry a cationic, anionic, amphoteric or nonionic charge. A suitable synthetic polymeric retention aid comprises, for example, at least one polymer from the group of nonionic polyacrylamides, nonionic polymethacrylamides, cationic polyacrylamides, cationic polymethacrylamides, anionic polyacrylamides, anionic polymethacrylamides, poly(N-vinylformamides), polymers comprising vinylamine units, and polydiallyldimethylammonium chlorides. The average molar mass $M_w$ of the polymeric retention aids is in each case at least 2 million daltons, preferably at least 3 million, and in the majority of cases is situated in the range from, for example, 3.5 million to 15 million. The charge density of the polymers under consideration is, for example, not more than 4.0 meq./g.

Particular preference is given to cationic polyacrylamides having an average molar mass $M_w$ of at least 5 million daltons and a charge density of 0.1 to 3.5 meq./g and to polyvinylamines which are obtainable by hydrolyzing polymers comprising vinylformamide units and have an average molar mass of at least 2 million. The polyvinylamines are prepared preferably by hydrolyzing homopolymers of N-vinylformamide, the degree of hydrolysis being, for example, up to 100%, mostly 70% to 95%. Additionally, high molecular mass copolymers of N-vinylformamide with other ethylenically unsaturated monomers such as vinyl acetate, vinyl propionate, methyl acrylate, methyl methacrylate, acrylamide, acrylonitrile and/or methacrylonitrile can be hydrolyzed to polymers comprising vinylamine units and used in accordance with the invention. In accordance with the invention use may be made, for example, of all polyvinylamines having a molar mass $M_w$ of at least 2 million which are obtainable by hydrolyzing polymers comprising vinylformamide units, the degree of hydrolysis of the vinylformamide units being 0.5 to 100 mol %. The preparation of N-vinylformamide homopolymers and copolymers is known. It is described extensively, for example, in U.S. Pat. No. 6,132,558, column 2 line 36 to column 5 line 25. The details given there are hereby incorporated by reference as part of the disclosure content of the present specification.

Cationic polyacrylamides are, for example, copolymers obtainable by copolymerizing acrylamide and at least one di-$C_1$ to $C_2$ alkylamino-$C_2$ to $C_4$ alkyl (meth)acrylate or a basic acrylamide in the form of the free bases, the salts with organic or inorganic acids, or the compounds quaternized with alkyl halides. Examples of compounds of this sort are dimethylaminoethyl methacrylate, diethylaminoethyl methacrylate, dimethylaminoethyl acrylate, diethylaminoethyl acrylate, dimethylaminopropyl methacrylate, dimethylaminopropyl acrylate, diethylaminopropyl methacrylate, diethylaminopropyl acrylate and/or dimethylaminoethylacrylamide, dimethylaminoethylmethacrylamide, dimethylaminopropylacrylamide, dimethylaminopropylmethacrylamide and/or diallyldimethylammonium chloride. These comonomers can also be copolymerized with methacrylamide to give cationic polymethacrylamides, which comprise, for example, 5 to 40 mol % of at least one cationic monomer, such as dimethylaminoethyl acrylate or diallyldimethylammonium chloride, in copolymerized form. Cationic polymethacrylamides may likewise be used as a polymeric retention aid in the microparticle system.

Further examples of cationic polyacrylamides and polymers comprising vinylamine units may be taken from the prior art references such as EP-A-0 910 701 and U.S. Pat. No. 6,103,065. Both linear and branched polyacrylamides can be used. Polymers of this sort are commercially customary products. Branched polymers, preparable for example by copolymerizing acrylamide or methacrylamide with at least one cationic monomer in the presence of small amounts of crosslinkers, are described for example in the cited prior art references U.S. Pat. No. 5,393,381, WO-A-99/66130, and WO-A-99/63159.

Further suitable polymeric retention aids of the microparticle system are poly(N-vinylformamides). They are prepared, for example, by polymerizing N-vinylformamide to give homopolymers or by copolymerizing N-vinylformamide together with at least one other ethylenically unsaturated monomer. The vinylformamide units of these polymers are not hydrolyzed, in contradistinction to the preparation of polymers comprising vinylamine units. The copolymers may be cationic, anionic or amphoteric. Cationic polymers are obtained, for example, by copolymerizing N-vinylformamide with at least one of the basic monomers mentioned in connection with the copolymerization of acrylamide. Anionic polymers of N-vinylformamide are obtainable by copolymerizing N-vinylformamide in the presence of at least one acidic monoethylenically unsaturated monomer. Examples of such comonomers include monoethylenically unsaturated $C_3$ to $C_5$ carboxylic acids, acrylamido-2-methylpropanesulfonic acid, styrenesulfonic acid, and sulfopropyl acrylate. The acidic monomers can also be used in a form completely neutralized with alkali metal, alkaline earth metal and/or ammonium bases for the copolymerization of N-vinylformamide. Said copolymers comprise units of anionic or cationic monomers in amounts, for example, of 0.5 to 50 mol %, preferably 5 to 40 mol %, in copolymerized form. Copolymers of N-vinylformamide may also be amphoteric if they comprise, in copolymerized form, units of anionic and cationic monoethylenically unsaturated monomers.

Further suitable retention aids are nonionic polyacrylamides and nonionic polymethacrylamides, which are obtainable by polymerizing acrylamide and/or methacrylamide, and also anionic polyacrylamides and anionic polymethacrylamides. The anionic poly(meth)acrylamides are obtainable, for example, by polymerizing acrylamide or methacrylamide with at least one anionic monomer. Examples of suitable anionic monomers include monoethylenically unsaturated $C_3$ to $C_5$ carboxylic acids such as acrylic acid, methacrylic acid, crotonic acid, maleic acid, fumaric acid, vinylacetic acid or ethacrylic acid, and also vinylphosphonic acid, styrenesulfonic acid, acrylamido-2-methylpropanesulfonic acid, sulfopropyl acrylate or sulfopropyl methacrylate, and the alkali metal, alkaline earth metal, and ammonium salts of monomers comprising acid groups. The anionic copolymers comprise, for example, 1 to 50 mol %, preferably 5 to 40 mol %, of at least one anionic monomer in copolymerized form. Additionally amphoteric copolymers of acrylamide and methacrylamide may be used as a polymeric retention aid in the microparticle system. Copolymers of this sort are obtainable by copolymerizing acrylamide or methyacrylamide in the presence of at least one anionic and at least one cationic ethylenically unsaturated monomer.

Further suitable cationic polymeric retention aids of the microparticle system are polydiallyldimethylammonium chloride (polyDADMAC) having an average molar mass of at least 2 million daltons. Polymers of this kind are commercial products.

The polymeric retention aids of the microparticle system are added to the paper stock in an amount of 0.005% to 0.5% by weight, preferably in an amount of 0.01% to 0.25% by weight, based on dry paper stock.

Suitable inorganic components of the microparticle system include, for example, bentonite, colloidal silica, silicates and/or calcium carbonate. By colloidal silica is meant products which are based on silicates, examples being silica microgel, silica sol, polysilicates, aluminosilicates, borosilicates, polyborosilicates, clay or zeolites. Calcium carbonate can be used, for example, in the form of chalk, milled calcium carbonate or precipitated calcium carbonate, as the inorganic component of the microparticle system. By bentonite is meant, generally speaking, phyllosilicates which are swellable in water. These are, in particular, the clay mineral montmorillonite and similar clay minerals, such as nontronite, hectorite, saponite, sauconite, beidellite, allevardite, illite, halloysite, aftapulgite and sepiolite. These phyllosilicates are preferably activated prior to their use; that is, they are converted into a water-swellable form by treatment with an aqueous base such as aqueous solutions of sodium hydroxide, potassium hydroxide, sodium carbonate, potassium carbonate, ammonia or amines. As an inorganic component of the microparticle system, preference is given to using bentonite in the form treated with sodium hydroxide solution, or those bentonites which are obtained already in the sodium form, known as Wyoming bentonites. The platelet diameter of the bentonite in dispersion in water, in the form treated with sodium hydroxide solution, is, for example, not more than 1 to 2 μm, the thickness of the platelets being about 1 nm. Depending on type and activation, the bentonite has a specific surface area of 60 to 800 $m^2/g$. Typical bentonites are described in, for example, EP-B-0235893. In the papermaking process, bentonite is added to the cellulose suspension typically in the form of an aqueous bentonite slurry. This bentonite slurry may comprise up to 10% by weight of bentonite. Normally the slurries comprise about 3% to 5% by weight of bentonite.

As colloidal silica it is possible to use products from the group of silicon-based particles, silica microgels, silica sols, alumino silicates, borosilicates, polyborosilicates, and zeolites. These products have a specific surface area of 50 to 1500 $m^2/g$ and an average particle size distribution of 1-250 nm, normally in the range 5-100 nm. The preparation of such components is described in, for example. EP-A-0 041 056, EP-A-0 185 068, and U.S. Pat. No. 5,176,891.

Clay or else kaolin is a water-containing aluminosilicate having a lamellar structure. The crystals have a layer structure and an aspect ratio (diameter-to-thickness ratio) of up to 30:1. The particle size is, for example, less than 2 μm for at least 50%.

Carbonates used are preferably natural calcium carbonate (ground calcium carbonate. GCC) or precipitated calcium carbonate (PCC). GCC is prepared, for example, by milling and classifying operations using milling assistants. It possesses a particle size of 40%-95% smaller than 2 μm, the specific surface area being in the range of 6-13 $m^2/g$. PCC is prepared, for example, by introducing carbon dioxide into an aqueous calcium hydroxide solution. The average particle size is in range of 0.03-0.6 μm. The specific surface area can be greatly influenced by the choice of precipitation conditions. It is in the range from 6 to 13 $m^2/g$.

The inorganic component of the microparticle system is added to the paper stock in an amount of 0.01% to 2.0% by weight, preferably in an amount of 0.1% to 1.0% by weight, based on dry paper stock.

In the process of the invention the aqueous fiber slurry, comprising if appropriate a filler, is subjected to at least one shear stage. In this case it passes through at least one cleaning, mixing and/or pumping stage. The pulp (low-consistency pulp) can be sheared, for example, in a pulper, classifier or refiner. In accordance with the invention the retention aid is metered into the low-consistency pulp at least two places, and the finely divided inorganic component is metered before or after the addition of the retention aids or between two metering places for retention aid. The process can be carried out, for example, such that the retention aid is added after the last shear stage at least two successive places and thereafter the finally divided inorganic component is metered. In another embodiment of the process of the invention the retention aid is added after the last shear stage at least two places whose distance from the shear stage is the same, and thereafter the finely divided inorganic component is metered. Alternatively the process may be performed by adding the retention aid before the last shear stage at least two places disposed in a plane perpendicular to the paper stock stream or successively, and by metering the finely divided inorganic component after the last shear stage. It is also possible, before the last shear stage, to meter first the finely divided inorganic component and then at least one retention aid, or a portion of the total retention aid to be used, and to add, after the last shear stage, the same or a different retention aid or the remaining retention aid. It is also possible, however, first to meter at least one retention aid into the low-consistency pulp, to subject the system to shearing, then to add at least one retention aid (which may be the same as or, preferably, different than the retention aid metered first), and subsequently to add at least one finely divided inorganic component.

By way of example, one possible procedure with the process of the invention is to meter first 25% to 75% by weight of the total retention aid before the last shear stage, and subsequently the remaining fraction of the retention aid, and then to add the finely divided inorganic component, or else first to meter the finely divided inorganic component and 25% to 75% by weight of the retention aid before the last shear stage, and the remaining fraction of the retention aid after the last shear stage.

In another embodiment of the process of the invention the finely divided inorganic component is metered in first in each case before the last shear stage and thereafter the retention aid is metered in at least two places disposed in a plane perpendicular to the paper stock stream or at successive places. The flow rate of the paper stock stream is, for example, at least 2 m/sec in the majority of paper machines and is mostly in the range from 3 to 7 m/sec. The metering of the retention aids may be performed, for example, by means of single-fluid or multi-fluid nozzles into the paper stream. This produces rapid distribution of the retention aids in the paper stock.

When retention aids are added consecutively the distance between the center point of the retention aid metering places is, for example, at least 20 cm. The distance between the center point of a metering place for retention aid and the center point of a metering place for the finely divided inorganic component is, for example, likewise at least 20 cm. The retention aid addition places may, however, also be disposed in a plane perpendicular to the paper stock stream. Preferably the distance between the center point of the metering places of the retention aids is at least 50 cm and the distance between the center point of a metering place for retention aid and the center point of a metering place for the finely divided inorganic component is at least 50 cm. In the majority of cases the distance between the center point of the metering places for the retention aids is, for example, in the range from 50 cm to 15 m, with the distance between the center point of a metering place for retention aids and the center point of a metering place for the finely divided inorganic component being, for example, at least 50 cm. The disposition of the addition places is preferably such that the distance between the center point of the retention aid metering places is 50 cm to 10 m and the distance between the center point of a metering place for retention aid and the center point of a metering place for the finely divided inorganic component is 50 cm to 5 m.

If, for example, there are two metering places available for retention aids, then the same retention aid, a cationic polyacrylamide or a polyvinylamine for example, can be metered in at both metering places, or two different retention aids can be used, e.g., a cationic polyacrylamide and diallyldimethylammonium chloride, or a polyvinylamine and a poly(N-vinylformamide), or a polyvinylamine and a cationic polyacrylamide. The retention aids may also be metered into the paper stock stream at 3 to 5 successive places. It is likewise possible to meter the finely divided inorganic component of the retention aid system into the paper stock stream at least two consecutive places.

Apart from the microparticle system, the paper stock may be admixed with the process chemicals normally used in papermaking, in the normal amounts, examples of these chemicals including fixing agents, dry and wet strength agents, engine sizing agents, biocides and/or dyes. The paper stock is in each case drained on a wire, and sheets are formed. The sheets thus produced are dried. Drainage of the paper stock and drying of the sheets are part of the papermaking process and are carried out continuously in the art.

According to the process of the invention, papers are obtained which have surprisingly good formation, and in relation to known microparticle processes an improved filler retention and fines retention are observed.

The percentages in the examples are by weight, unless indicated otherwise by the context.

The first pass retention (FPR) was determined by ascertaining the ratio between the solids content in the white water and the solids content in the headbox. It is reported as a percentage.

The first pass ash retention (FPAR) is determined in the same way as for the FPR, but taking into account only the ash content.

The formation was measured using a TECHPAP 2D Lab Formation Sensor from Techpap. The dimensionless FX value is reported in the table. The lower this value, the better the formation of the paper tested.

For the microparticle system the following retention aids were used:

Polymin® 215: linear cationic acrylamide copolymer with an average molar mass $M_w$ of 8 million, a charge density of 17 meq/g and a solids content of 46%

Polymin® PR 8186: branched cationic acrylamide copolymer having an average molar masse $M_w$ of 7 million, a charge density of 1.7 meq/g and a polymer content of 46%.

The inorganic component of the microparticle system used was Mikrofloc® XFB. Mikrofloc® XFB is a bentonite powder activated by treatment with aqueous sodium hydroxyide solution. It is normally converted in situ into a 3%-5% suspension.

EXAMPLES

The following inventive and comparative examples were carried out on an experimental paper machine with GAP former. First a bleached chemical pulp was used to produce a pulp having a density of 8 g/l containing 20% of calcium carbonate filler, and in each of the inventive and comparative examples this pulp was processed to a chemical writing and printing paper having a basis weight of 80 g/m$^2$. The paper machine comprised the following arrangement of mixing and shearing units: mixing chest, dilution, devolatilizer, screen (wire), and headbox. One metric ton of paper was produced per hour. The addition (amount and metering place) of retention aid and finely divided inorganic component was varied as indicated in the inventive and comparative examples. The results obtained in each case are reported in the table.

Inventive Example 1

650 g/t Polymin 215 ("650 g/t" means that 650 g of Polymin® 215 were used per metric ton of paper produced) were supplied in 2 metered amounts of 350 g/t and 300 g/t to the paper stock described above, with a distance of 300 cm between the metering places, before the screen in each case, and thereafter 2500 g/t Microfloc® XFB were supplied, after the screen, to the paper stock described above.

Comparative Example 1

Example 1 was repeated with the sole exception that the retention aid 050 g/t Polymin 215) was metered in at a single place, 400 cm before the screen.

Inventive Example 2

450 g/t Polymin 215 were added continuously to the paper stock in 2 metered amounts of 250 g/t and 200 g/t, with a distance of 200 cm between the metering places, in each case after the screen, and thereafter 2500 g/t Microfloc XFB, likewise after the screen, were added continuously to the paper stock.

Comparative Example 2

Example 2 was repeated with the sole exception that the retention aid (450 g/t Polymin 215) was metered in at a single place.

Inventive Example 3

For each metric ton of dry paper produced, 500 g of polyacrylamide in 2 metered amounts, with a distance of 2 m between the metering places, were added continuously to the paper stock stream, in each case after the screen, the metering taking place first with 250 g Polymin® 215 and then with 250 g Polymin® PR 8186, and, subsequently, 2500 g Microfloc® XFB were metered (likewise after the screen).

Example 4

For each metric ton of dry paper produced, 500 g of Polymin® 215 in 2 metered amounts were added to the paper stock stream, in each case continuously the metering taking place first with 250 g Polymin® 215 before the screen and then with 250 g Polymin® 215 after the screen, and, subsequently, 2500 g Microfloc® XFB were metered (likewise after the screen). The distance of the 1st metering place for the retention aid was 4 m before the screen, the distance of the 2nd metering place from the screen was 2 m, and the distance between the metering place for Microfloc® XFB and the screen was 5 m.

TABLE

| | FPR (%) | FPAR (%) | Formation/Techpap |
|---|---|---|---|
| Inv. 1 | 79.1 | 54.2 | 97.6 |
| Comp. 1 | 78.0 | 52.1 | 122.3 |
| Inv. 2 | 81.5 | 58.3 | 81.7 |
| Comp. 2 | 80.7 | 56.4 | 99.6 |
| Inv. 3 | 81.0 | 58.1 | 75.3 |
| Inv. 4 | 82.1 | 59.7 | 98.3 |

The invention claimed is:

1. A process for producing a paper, a board or a cardboard by adding a microparticle system comprising a cationic polymeric retention aid having a molar mass $M_w$ of at least 2 million and a finely divided inorganic component to a paper stock having a density of not more than 20 g/l and draining the paper stock, the paper stock being subjected, before or after the addition of the cationic polymeric retention aid, to at least one shear stage, wherein said adding comprises metering the cationic polymeric retention aid into the paper stock at least two places and metering the finely divided inorganic component after the addition of the cationic polymeric retention aid.

2. The process according to claim 1, wherein the cationic polymeric retention aid is added after the last shear stage at least two successive places and thereafter the finely divided inorganic component is metered.

3. The process according to claim 1, wherein the cationic polymeric retention aid is added after the last shear stage at least two places which are at equal distance from the shear stage, and thereafter the finely divided inorganic component is metered.

4. The process according to claim 1, wherein the cationic polymeric retention aid is added before the last shear stage at least two places which are disposed in a plane perpendicular to the paper stock flow or successively, and the finely divided inorganic component is metered after the last shear stage.

5. The process according to claim 1, wherein 25% to 75% by weight of the total amount of the cationic polymeric retention aid is metered before the last shear stage and the remaining fraction of the cationic polymeric retention aid is metered thereafter, and subsequently the finely divided inorganic component is added.

6. The process according to claim 1, wherein the distance between the center point of the cationic polymeric retention aid metering places is at least 20 cm and wherein the distance between the center point of a metering place for the cationic polymeric retention aid and the center point of a metering place for the finely divided inorganic component is at least 20 cm.

7. The process according to claim 1, wherein the distance between the center point of the cationic polymeric retention aid metering places is at least 50 cm and wherein the distance between the center point of a metering place for the cationic polymeric retention aid and the center point of a metering place for the finely divided inorganic component is at least 50 cm.

8. The process according to claim 1, wherein the distance between the center point of the cationic polymeric retention aid metering places is 50 cm to 15 m and wherein the distance between the center point of a metering place for the cationic polymeric retention aid and the center point of a metering place for the finely divided inorganic component is at least 50 cm.

9. The process according to claim 1, wherein the distance between the center point of the cationic polymeric retention aid metering places is 50 cm to 10 m and wherein the distance between the center point of a metering place for the cationic polymeric retention aid and the center point of a metering place for the finely divided inorganic component is 50 cm to 5 m.

10. The process according to claim 1, wherein said cationic polymeric retention aid comprises at least one polymer selected from the group consisting of a nonionic polyacrylamide, a cationic polyacrylamide, an anionic polyacrylamide, a poly(N-vinylformamide), a polymer comprising a vinylamine unit, and a diallyldimethylammonium chloride.

11. The process according to claim 1, wherein said cationic polymeric retention aid comprises at least one cationic polymer having a charge density of not more than 4 meq/g.

12. The process according to claim 1, wherein said cationic polymeric retention aid comprises at least one polymer having a molar mass $M_w$ of at least 3 million.

13. The process according to claim 1, wherein said cationic polymeric retention aid comprises at least one polyvinylamine obtained by hydrolyzing a polymer comprising a vinylformamide unit, the degree of hydrolysis of the vinylformamide unit being 5 to 100 mol %.

14. The process according to claim 1, wherein the cationic polymeric retention aid is present in an amount of 0.005% to 0.5% by weight, based on a total weight of dry paper stock.

15. The process according to claim 1, wherein the cationic polymeric retention aid is present in an amount of 0.001% to 0.25% by weight, based on a total weight of dry paper stock.

16. The process according to claim 1, wherein said finely divided inorganic component of the microparticle system comprises at least one finely divided inorganic component selected from the group consisting of bentonite, colloidal silica, silicate, calcium carbonate and mixtures thereof.

17. The process according to claim 1, wherein the finely divided inorganic component of the microparticle system is present in an amount of 0.01% to 2.0% by weight, based on a total weight of dry paper stock, and is metered into the paper stock flow at least two places disposed consecutively.

18. The process according to claim 1, wherein the cationic polymeric retention aid is metered into the pulp flow at 3 to 5 places disposed successively.

19. The process according to claim 1, wherein the finely divided inorganic component of the microparticle system is present in an amount of 0.1% to 1.0% by weight, based on a total weight of dry paper stock, and is metered into the paper stock flow at least two places disposed consecutively.

20. The process according to claim 1, wherein the finely divided inorganic component of the microparticle system comprises an activated bentonite which is obtained by converting bentonite into a water-swellable form via treatment with an aqueous solution selected from the group consisting of an aqueous solution of sodium hydroxide, an aqueous solution of potassium hydroxide, an aqueous solution of sodium carbonate, an aqueous solution of potassium carbonate, an aqueous solution of ammonia, and an aqueous solution of an amine.

* * * * *